US007779779B2

(12) United States Patent
Ferguson et al.

(10) Patent No.: US 7,779,779 B2
(45) Date of Patent: Aug. 24, 2010

(54) SPRAY BOOTH

(75) Inventors: John D. Ferguson, Kent, WA (US); Mark F. Gabriel, Renton, WA (US); Christopher R. Carter, Pacific, WA (US); Kevin M. Bell, Maple Valley, WA (US); Candace Propp, Bonney Lake, WA (US); David O. Wagner, Tacoma, WA (US); Daniel J. Wells, Gig Harbor, WA (US)

(73) Assignee: The Boeing Company, Chicago, IL (US)

( * ) Notice: Subject to any disclaimer, the term of this patent is extended or adjusted under 35 U.S.C. 154(b) by 1349 days.

(21) Appl. No.: 11/250,973

(22) Filed: Oct. 14, 2005

(65) Prior Publication Data

US 2007/0092657 A1 Apr. 26, 2007

(51) Int. Cl.
*B05B 1/28* (2006.01)

(52) U.S. Cl. ..... 118/326; 118/DIG. 7

(58) Field of Classification Search ..... 118/DIG. 7, 118/326, 308–309, 602, 66, 64; 55/385.2, 55/DIG. 18, DIG. 46; 454/184; 96/417, 96/421, 422

See application file for complete search history.

(56) References Cited

U.S. PATENT DOCUMENTS

| | | | | |
|---|---|---|---|---|
| 2,347,728 | A | 5/1944 | Bell | 183/107 |
| 2,498,339 | A * | 2/1950 | Miskella | 118/642 |
| 2,761,373 | A * | 9/1956 | Owen | 454/55 |
| 4,023,943 | A * | 5/1977 | Kipple et al. | 55/304 |
| 4,675,203 | A * | 6/1987 | Scarbrough | 427/180 |
| 4,685,385 | A * | 8/1987 | Rich | 454/52 |
| 4,924,801 | A | 5/1990 | Arnone | 118/58 |
| 4,975,305 | A * | 12/1990 | Biginelli | 427/354 |
| 5,279,631 | A * | 1/1994 | Pingel | 55/294 |
| 5,282,145 | A * | 1/1994 | Lipson et al. | 700/208 |
| 6,503,324 | B1 * | 1/2003 | Adair et al. | 118/309 |
| 6,887,293 | B1 * | 5/2005 | Abad et al. | 55/385.2 |
| 2004/0089231 | A1 * | 5/2004 | Gilmore et al. | 118/425 |
| 2006/0130752 | A1 * | 6/2006 | McLaughlin | 118/313 |

OTHER PUBLICATIONS

Description of Fume Booth 800, of Airflow Systems, Inc., on www.airflowsystems.com/index/fumebooth800.html printed on Oct. 13, 2005.

* cited by examiner

*Primary Examiner*—Brenda A Lamb
(74) *Attorney, Agent, or Firm*—Klintworth & Rozenblat IP LLC

(57) ABSTRACT

The present application is directed to a spray booth comprising a first enclosure for applying spray material and a second enclosure for drying spray material. An exhaust system is in fluid connection with the first and second enclosures. A fire suppression system is in fluid connection with at least one component chosen from the first enclosure, the second enclosure and the exhaust system. A processor is in data communication with at least one component chosen from the spray enclosure, the drying enclosure, the exhaust system and the fire suppression system.

22 Claims, 7 Drawing Sheets

SPRAY BOOTH

BACKGROUND

This disclosure relates generally to equipment for spraying materials, such as paint, and, more particularly, to booths for spraying such materials.

Many manufacturing processes involve the application of one or more materials, such as paint, to the parts being manufactured. In large-scale industrial settings, the application of such materials is often carried out at dedicated facilities with specialized equipment for handling volatile materials. This equipment frequently includes specialized systems, such as, for example, advanced ventilation systems with ducting to the exterior of the production facility for venting volatile organic compounds, and fire suppression systems, which may not be required by other steps of the manufacturing process. In addition, dedicated painting facilities are often operated by personnel with specialized skills, which adds to the cost of production.

In certain manufacturing applications, it is desirable to collect in a single location all the equipment necessary to complete the manufacture of a given part. One example of such an application is a "Chaku-Chaku" production line. Chaku-Chaku is a Japanese term meaning "load-load"; it is a method of conducting single-piece production flow in which an operator proceeds from machine to machine, taking a part from one machine and loading it in the next, then taking the part just removed from that machine and loading it in the following machine, and so on. Chaku-Chaku production lines allow different steps of a manufacturing process to be completed by a single operator, thereby eliminating the need to move around large batches of work-in-progress inventory.

In some cases, parts being manufactured in a Chaku-Chaku production line or in similar settings require the application of one or more materials, such as paint. In such cases, it is often necessary to interrupt the process flow and transport batches of unfinished parts to a dedicated facility for application of the appropriate material and then wait for the parts to be returned, which can take 24 hours or longer in some cases. Typically, this procedure is inconvenient and disruptive to the overall flow of the manufacturing process, and it can add significant inefficiencies to the process.

BRIEF DESCRIPTION

The above-mentioned drawbacks associated with existing manufacturing lines and processes are addressed by embodiments of the present invention, which will be understood by reading and studying the following specification.

According to a number of embodiments, a spray booth is configured to be portable, self-contained, and easy to operate so that parts do not have to be sent to an off-line dedicated painting facility to be painted. Rather, the self-contained spray booth can be moved and located to the production line so that parts can be painted as close to an in situ arrangement as possible. The self-contained spray booth therefore eliminates the need to remove the parts from the production line and to send the parts to an off-line facility. The self-contained spray booth also eliminates the need to maintain a dedicated staff of specialized painters to man an off-line painting facility. Accordingly, production costs are reduced and productivity is increased.

In one embodiment, a portable self-contained spray booth enables an aircraft component to be painted at or near a production line in a manufacturing facility having interior ambient air. The spray booth comprises a frame structure, an enclosure in which the component is painted, and an exhaust system in pneumatic connection with the enclosure. The exhaust system includes a filtering subsystem configured to filter the air from the enclosure and a venting subsystem configured to vent the filtered air to the interior ambient air of the manufacturing facility.

In another embodiment, a portable painting system enables a part to be painted at or near a production line in a manufacturing facility having interior ambient air. The system comprises a frame including a plurality of wheels and a self-contained spray booth configured to paint the component. The self-contained spray booth comprises a first enclosure in which the part is painted, the first enclosure being mounted to the frame, and a second enclosure in which spray material is dried on the part, the second enclosure being mounted to the frame. The self-contained spray booth is mounted on the frame such that the spray booth is positionable at a location near the production line and repositionable at another location.

In another embodiment, a method for painting an aircraft component comprises loading the component into an enclosure of a self-contained spray booth portably located in a manufacturing facility having interior ambient air and initiating a painting procedure of the spray booth. The painting procedure includes applying spray material to the component, filtering air from the enclosure, and exhausting the filtered air to the interior ambient air of the manufacturing facility.

In another embodiment, a method for manufacturing an aircraft structure in a production line of a manufacturing facility having interior ambient air comprises providing a portable self-contained spray booth. The spray booth includes a painting system that is configured to paint an aircraft component and an exhaust system that is configured to filter air contaminated by the painting system and to exhaust the filtered air to the interior ambient air of the manufacturing facility. The spray booth also includes a control system in communication with the painting system and the exhaust system and for controlling a paint procedure that includes at least painting the component and exhausting the filtered air. The method further comprises positioning the spray booth at or near the production line, loading an aircraft component into the spray booth, and actuating the control system to initiate the painting procedure.

These and other embodiments of the present application will be discussed more fully in the detailed description. The features, functions, and advantages can be achieved independently in various embodiments of the present application, or may be combined in yet other embodiments.

DRAWINGS

Like reference numbers and designations in the various drawings indicate like elements.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical, and electrical changes may be made without departing from the spirit and scope of the present invention. The following detailed description is, therefore, not to be taken in a limiting sense.

Figure 1:
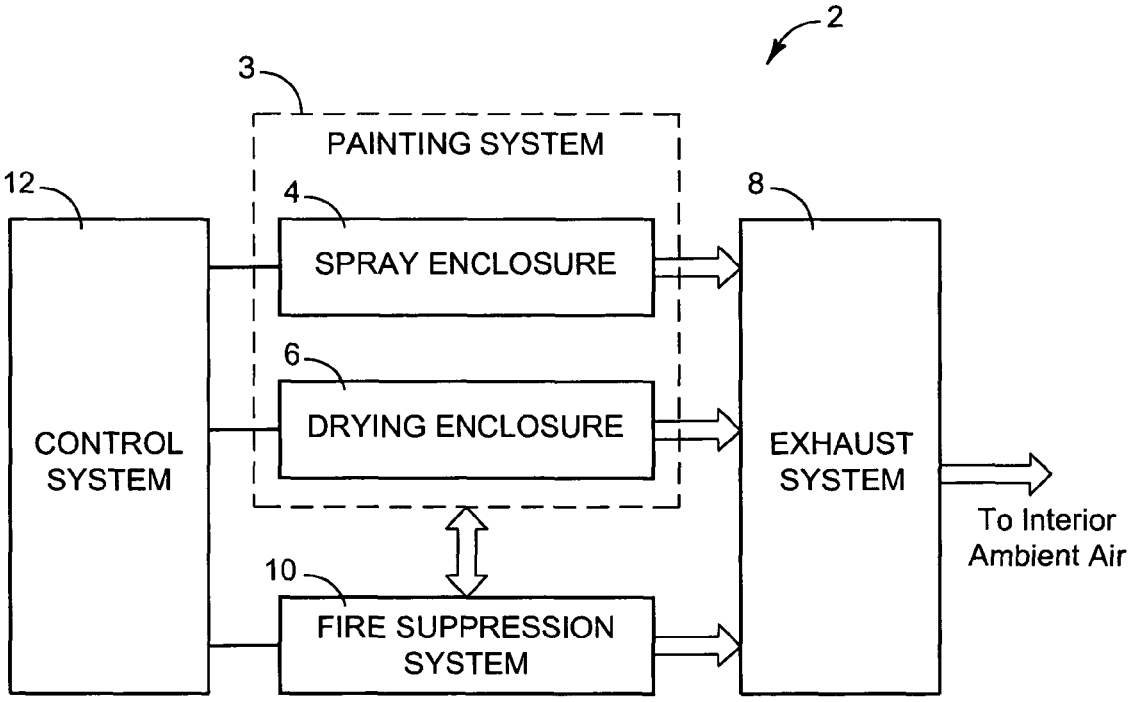
FIG. 1 is a block diagram of a self-contained spray booth, according to one embodiment of the present application.

FIG. 1 illustrates a block diagram of a spray booth 2, according to one embodiment of the present application. As illustrated, spray booth 2 may comprise a number of system components, including a painting system 3 having a first or spray enclosure 4 in which a spray material is applied to a component or part and a second or drying enclosure 6 for drying the spray material on the component or part. As used herein, the term "paint" includes application of any spray material or coating, such as, for example, paint or primer. In addition, the component or part may comprise any part to which a spray material may be applied. In one embodiment, for example, the part is an aircraft component to which a spray material, such as paint or primer, is applied.

Spray enclosure 4 and drying enclosure 6 may be in fluid connection with an exhaust system 8, which may provide filtering and/or control of the exhaust flow. A fire suppression system 10 may be in fluid connection with at least one component chosen from the spray enclosure 4, the drying enclosure 6 and the exhaust system 8. A control system 12 including a processor may be in data communication with at least one component chosen from spray enclosure 4, drying enclosure 6, exhaust system 8 and fire suppression system 10. These components and there inter-relationships will be described in greater detail below.

While the particular configuration of system components illustrated in FIG. 1 provides certain advantages, as will be discussed below, the spray booth is not limited to the components illustrated, and may comprise additional components which are not illustrated, or alternatively may lack certain components which are illustrated. For example, in one embodiment, spray booth 2 may lack a drying enclosure. In another embodiment, spray booth 2 may comprise multiple drying enclosures 6 and/or multiple spray enclosures 4. Further, depending on the fire code regulating the material being sprayed, certain embodiments may lack a fire suppression system.

In operation, spray booth 2 may provide a convenient, self-contained means for applying sprayable material onto parts being manufactured in an enclosed space, such as the interior of a manufacturing building, or other facility. In one embodiment, an operator may load a part to be sprayed into spray enclosure 4. A sprayable material, such as paint or primer, is applied to the part in spray enclosure 4. In one embodiment, the application of the sprayable material may be automated to provide a hands-off spray process. Once the sprayable material is applied, the operator may remove the sprayed part and then load it into the drying enclosure 6. In one embodiment, the drying process may also be automated so that drying conditions are controlled once the part is loaded.

Once the operator removes the first part from spray enclosure 4, a second part may then be loaded into spray enclosure 4, so that spraying of the second part and drying of the first part occur simultaneously. Thus, spray booth 2 of the embodiment of FIG. 1 enables Chaku-Chaku production line processing by allowing the spraying and drying steps of a manufacturing process to be completed by a single operator in a "load-load" fashion. In some embodiments this may provide certain efficiencies, such as eliminating the need to move around large batches of parts for spraying and drying.

Figure 2A:
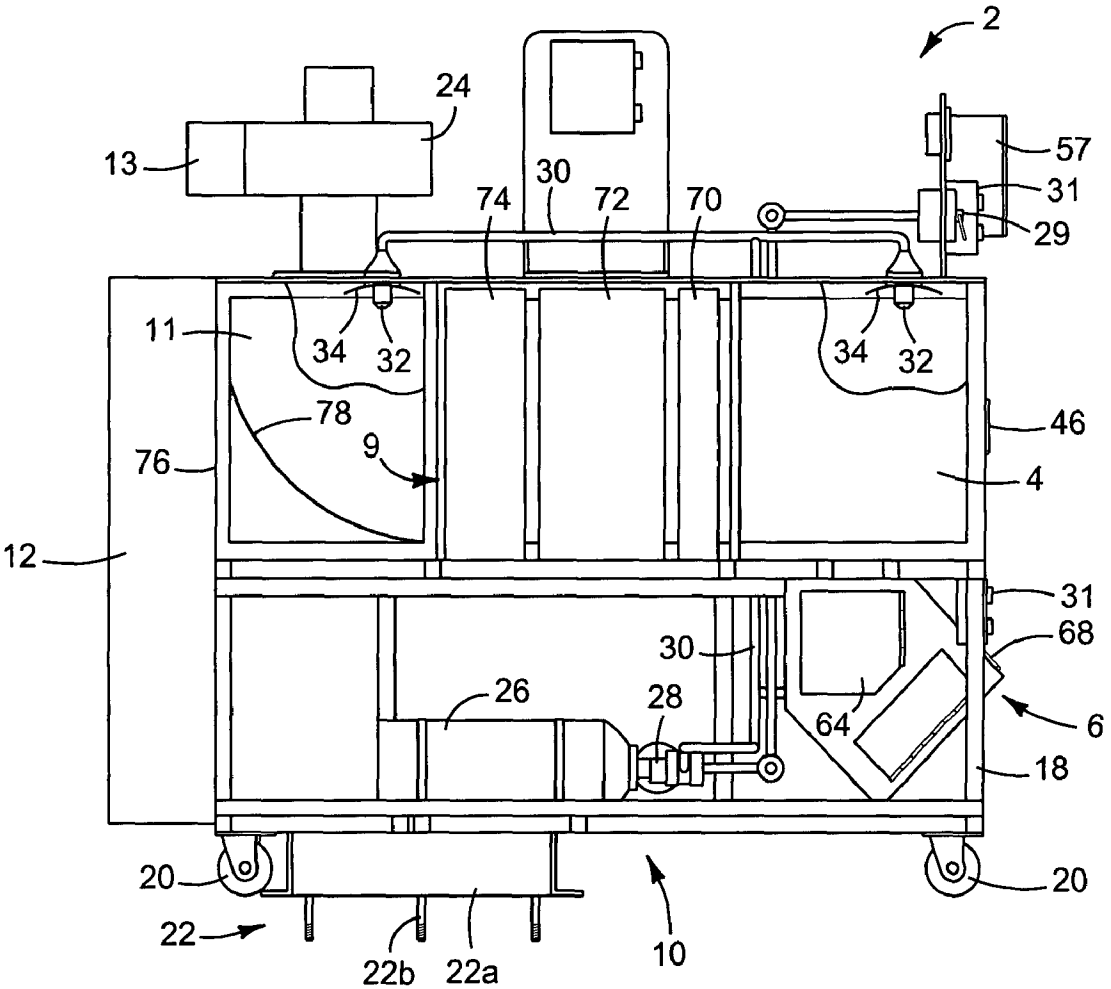
FIGS. 2A and 2B are front and side views of a self-contained spray booth, according to one embodiment of the present application.
Figure 2B:
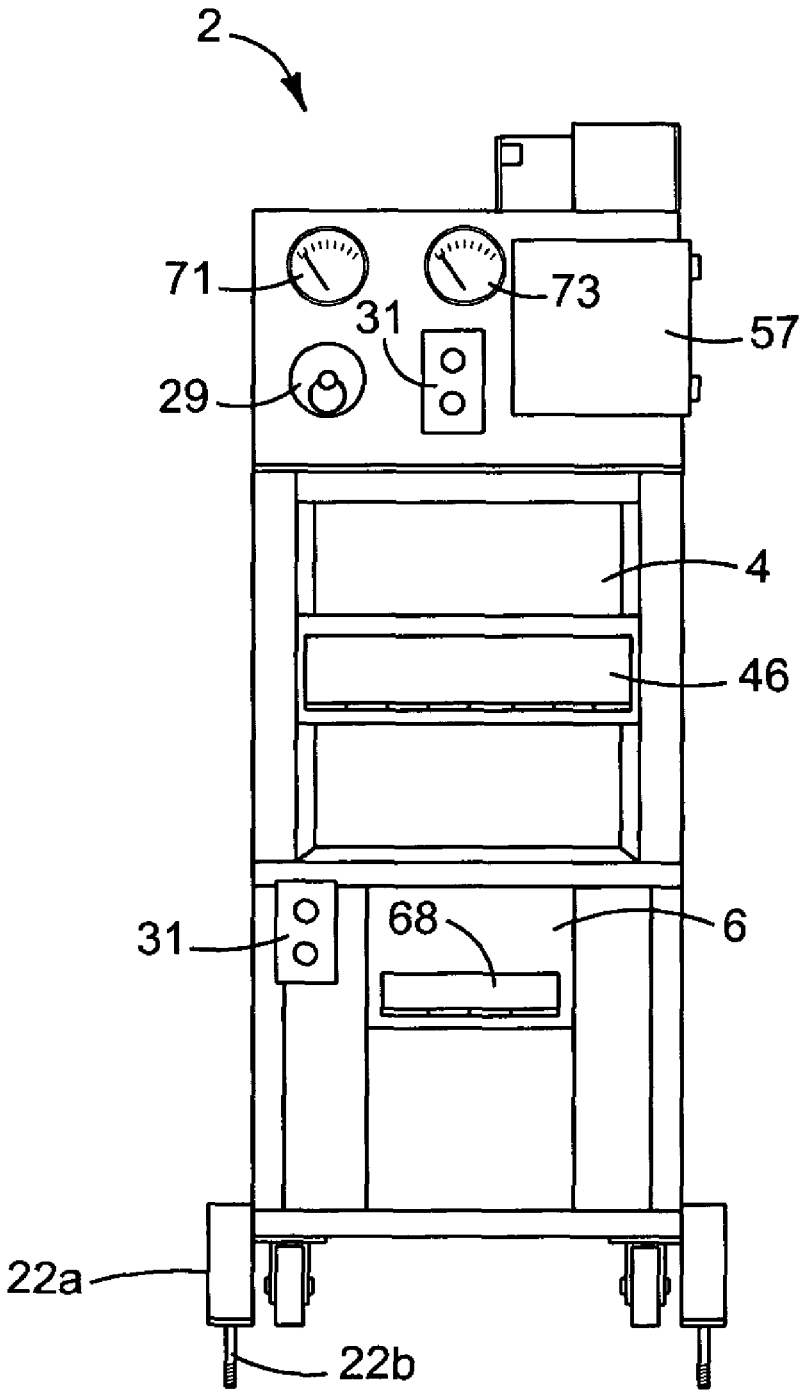

FIGS. 2A and 2B illustrate a spray booth 2, according to one embodiment of the present application. In the illustrated embodiment, spray booth 2 comprises a number of system components, similar to those illustrated in the block diagram of FIG. 1, including a spray enclosure 4 for applying a spray material to a part, a drying enclosure 6 for drying the spray material on the part, a fire suppression system 10 and a control system 12. An exhaust system 8 comprises a filtering mechanism 9, an air plenum chamber 11, and an exhaust conduit 13.

Figure 3:
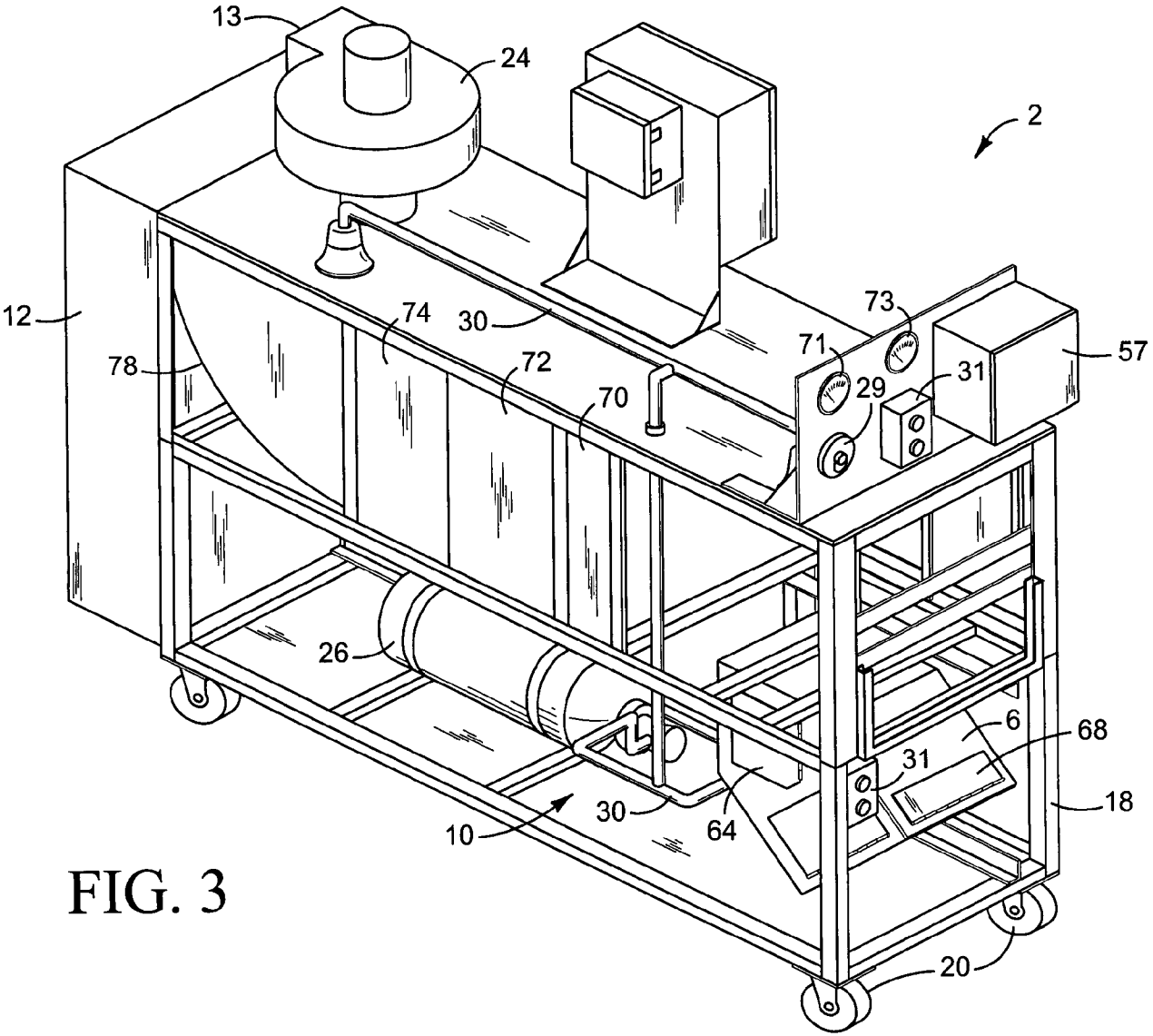
FIG. 3 is a three-dimensional perspective view of a self-contained spray booth, according to one embodiment of the present application.

In the embodiment of FIG. 2, the various system components are supported on a frame structure 18. One embodiment of a frame structure 18 is shown in FIGS. 2 and 3. In FIG. 3, a three-dimensional perspective view of spray booth 2 is shown without certain components, such as spray enclosure 4, so that frame structure 18 may be more clearly illustrated. Frame structure 18 may provide a convenient, self-contained arrangement of the components. In certain embodiments, spray booth 2 may be portable. For example, spray booth 2 may include wheels 20, so that it may be easily transported to any desired location in, for example, a manufacturing plant.

Referring again to the embodiment of FIGS. 2A and 2B, frame structure 18 may include a stabilizing mechanism 22, which may be used to stabilize, level and/or anchor the spray booth 2 in the desired location. Any suitable mechanism which will provide the desired stabilizing benefits may be employed. For example, in the embodiment of FIG. 2, stabilizing mechanism 22 comprises a supporting member 22*a* and anchoring means 22*b*. Supporting member 22*a* may comprise, for example, angled metal, such as aluminum or iron, or any other suitable structure which may be attached to frame structure 18 to provide the desired support. Anchoring means 22*b* may comprise, for example, lag bolts, or any other suitable means for anchoring frame structure 18 to the floor. Stabilizing mechanism 22 allows spray booth 2 to be fixed to the floor to reduce movement during, for example, seismic activity.

While illustrated frame structure 18 provides certain benefits, as mentioned above, any other suitable frame mechanism may be employed. For example, in certain embodiments, frame structures without wheels or which are not portable can be utilized. In other embodiments, other suitable frame structures which support the various components of spray booth 2 in a different arrangement than that illustrated in FIG. 1 are contemplated. For example, in one embodiment, the spray enclosure 4 and drying enclosure 6 may be positioned at approximately the same height level on a frame structure, rather than one above the other. In yet other embodiments, frame structure 18 may not include stabilizing mechanism 22, as illustrated in FIG. 3, or may employ other means for stabilizing the frame structure and/or rendering it immobile. Still other designs of the frame structure and arrangements of the system components thereon would be readily apparent to one of ordinary skill in the art, and would fall within the scope of the present application.

Figure 4:
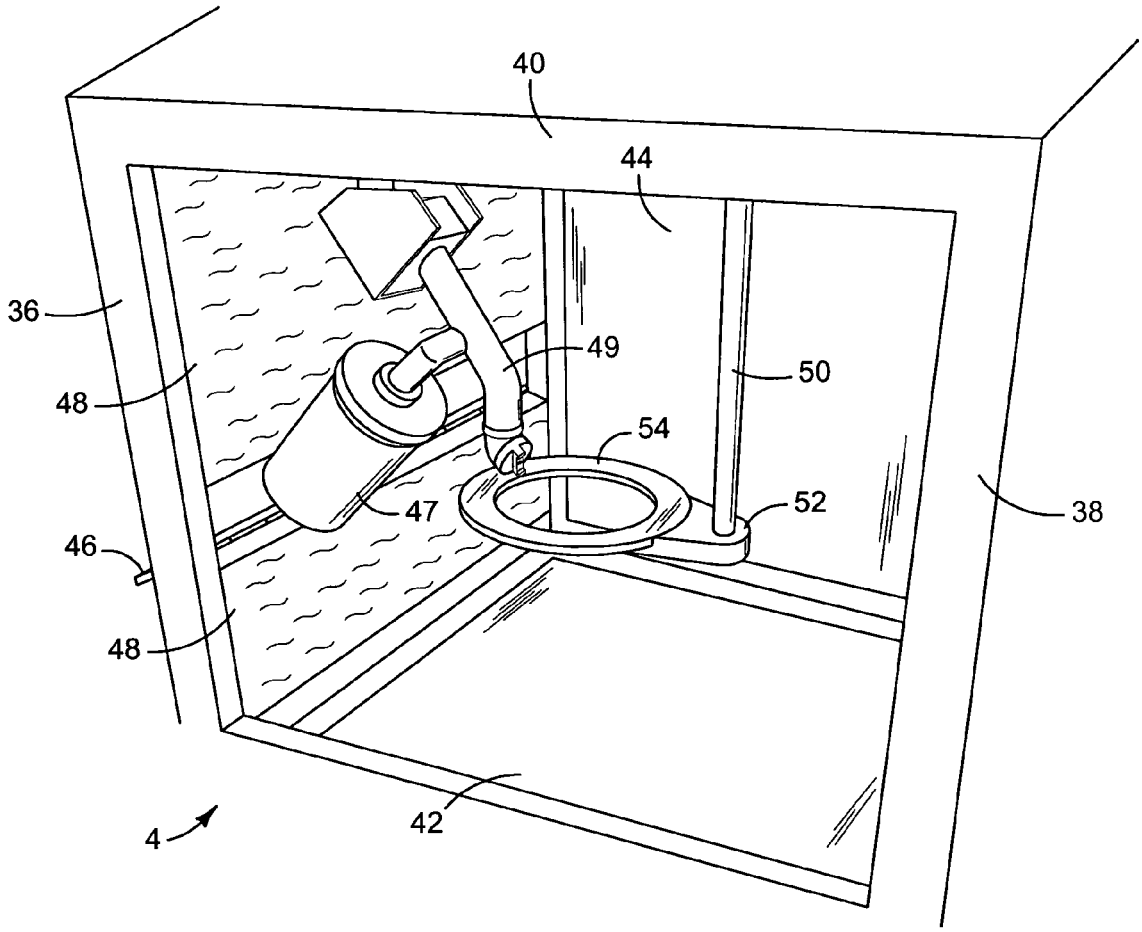
FIG. 4 is a schematic drawing of a spray enclosure which may be employed in a self-contained spray booth, according to one embodiment of the present application.

Spray enclosure 4 will now be described in greater detail. FIG. 4 illustrates one embodiment of a spray enclosure 4 which is completely enclosed, comprising a front wall 36, a back wall 38, a top wall 40, a floor 42 and side walls 44. In the illustrated embodiment, front wall 36 may comprise a door 46 for loading a part into spray enclosure 4 during operation of spray booth 2. Front wall 36 further comprises air intake filters 48 located above and below door 46. Front wall 36 may be attached to spray enclosure 4 so as to allow it to be opened, or easily removed, to allow the operator access to the inside of spray enclosure 4. Back wall 38 and floor 42 may comprise, for example, sacrificial filters for capturing overspray during operation. Top wall 40 and side walls 44 may comprise any suitable material, such as, for example, plastics or metals, such as stainless steel.

In the illustrated embodiment, a spray gun 47 is hung from a mounting arm 49. Any suitable spray gun may be employed. For example, spray gun 47 may comprise a pneumatic spray gun. One example of a commercially available spray gun is a Binks Mach 1 HVLP Paint Gun, commercially available from Finishing Technologies.

A robotic arm 50 and part holder 52 may be employed for holding and manipulating a part 54 in spray enclosure 4. Robotic arm 50 may include any suitable driving means for moving the arm, including, for example, pneumatic cylinders and motors, such as encoder motors, as is well known in the art. Robotic arms are generally well-known, and the particular design and construction of the robotic arm is within the ordinary skill of the art.

Robotic arm 50 may be controlled via control system 12, shown in FIG. 2A, to automatically process part 54, in any desired manner. For example, robotic arm 50 may be controlled via control system 12 to automatically position part holder 52 through door 46 so that part 54 may be loaded by the operator. Robotic arm 50 may then position part 54 within spray enclosure 4 and rotate part 54 under the spray from spray gun 47 to coat part 54 with the spray material. After the desired number of coats are applied, robotic arm 50 may automatically eject part 54 from spray enclosure 4 through door 46 for unloading, and subsequent loading of a new part.

In certain embodiments, spray booth 2 may include a control means for allowing adjustments to the spray process by the operator and for displaying pertinent information regarding the spray process. For example, in the embodiment illustrated by FIG. 2A, a control screen 57 is provided to allow the operator to make adjustments to, for example, the speed of rotation of part 54 by robotic arm 50, thereby adjusting the spray speed to accommodate changes in temperature and humidity. In yet other embodiments, control screen 57 may alert the operator to process conditions which may warrant interruption of the process and/or non-operation of spray enclosure 4, such as when a desired air flow through the chamber is not achieved, or when spray gun 47 becomes clogged.

The design of spray enclosure 4 may be altered in a variety of ways to accommodate different spray processes and/or the spraying of different types of parts. For example, filters may be positioned in top wall 40 and side walls 44 in place of, or in addition to filters 48, or the sacrificial filters in back wall 38 and floor 42. In another embodiment, spray enclosure 4 may be designed with an open side, rather than being totally enclosed, to allow one or more operators to access the interior of spray enclosure 4 during processing. In another embodiment, robotic arm 50 and part holder 52 may be designed to accept parts of different shapes and sizes, and to position them in any manner desired. In yet other embodiments, multiple spray guns 47 may be employed within spray enclosure 4. Still other designs and modifications would be readily apparent to one of ordinary skill in the art, and fall within the scope of the present application.

Figure 5:
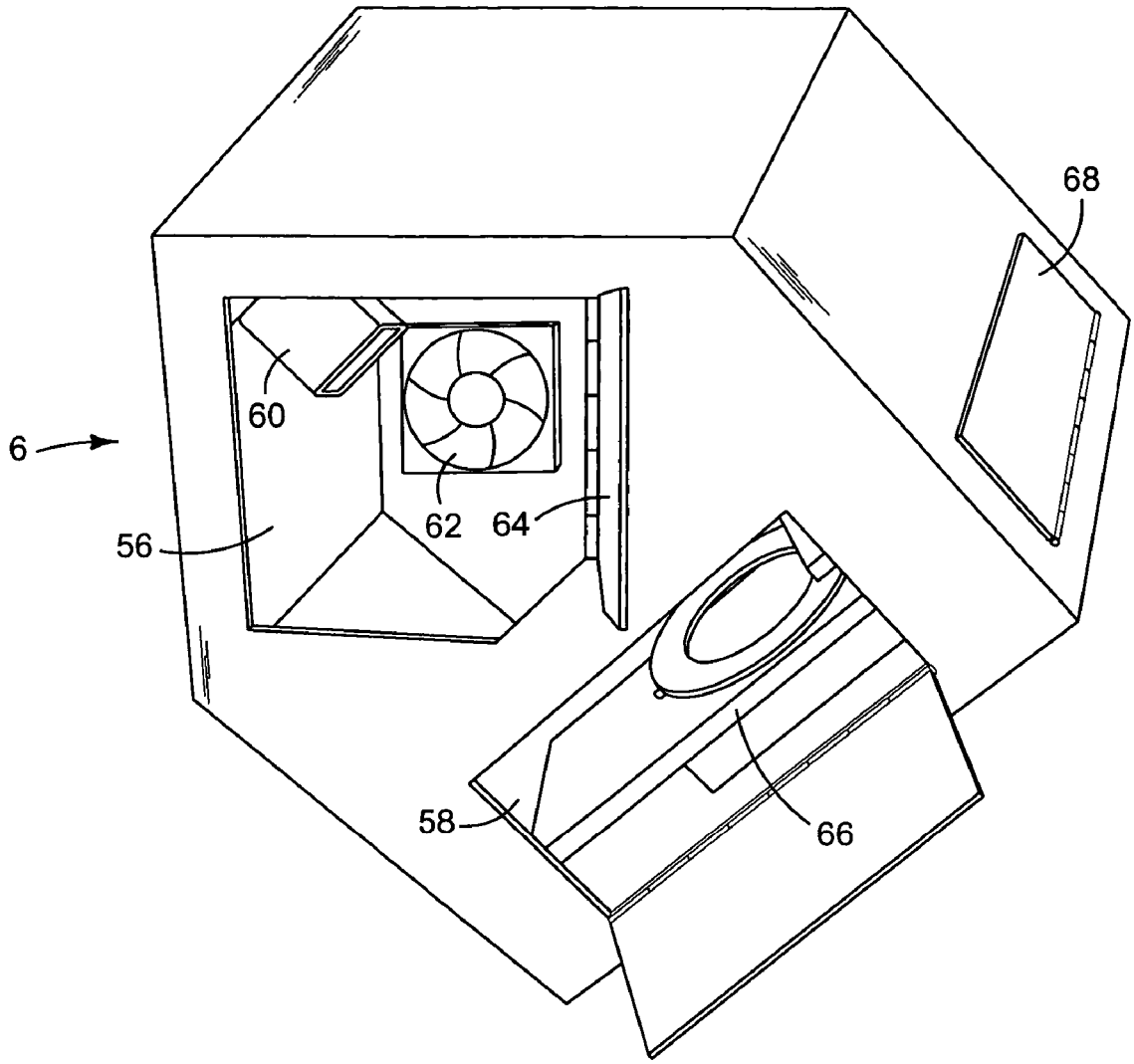
FIG. 5 is a schematic drawing of a drying enclosure which may be employed in a self-contained spray booth, according to one embodiment of the present application.

FIG. 5 is a schematic drawing illustrating one embodiment of drying enclosure 6. In the illustrated embodiment, drying enclosure 6 comprises two separate chambers: a heating chamber 56 and a part chamber 58. Heating chamber 56 comprises a heating element 60 and an exhaust fan 62, which air cools heating chamber 56. Heating element 60 may comprise any suitable heating element, such as, for example, an infrared bulb, that generates a sufficient amount heat to dry a part within a selected period of time. In some embodiments, heating chamber 56 comprises an access panel 64, which enables a user to access heating chamber 56 for routine maintenance and periodic replacement of heating element 60.

Part chamber 58 comprises a tray 66 on which a sprayed part rests during the drying process. During this process, part chamber 58 can be vented through the same filtering mechanism 9 as spray enclosure 4. Part chamber 58 comprises a door 68, which can be opened to place a part on tray 66 and closed to enclose the part within part chamber 58 during drying. If desired, tray 66 can slide into and out of part chamber 58 and can be operated with a motorized slide mechanism to facilitate easy access to part chamber 58.

As illustrated in the embodiment of FIG. 2A, drying enclosure 6 is located below spray enclosure 4 and is angled at, for example, about 45°, to enable a user to access the drying enclosure 6 without excessive bending or crouching. However, as discussed above, drying enclosure 6 may be located in any suitable position relative to the other components of spray booth 2.

In some embodiments, drying enclosure 6 comprises one or more sensors on the front of part chamber 58 to detect whether a part is present on tray 66 or not. The output of the sensors can be utilized by control system 12 to control the operation of drying enclosure 6. For example, if the one or more sensors indicate that a part is present when tray 66 slides into the part chamber 58 and door 68 is closed, heating element 60 can be automatically activated to begin the drying process. Otherwise, if no part is present when tray 66 slides into part chamber 58, control system 12 can prevent activation of heating element 60 when door 68 is closed.

During operation of spray booth 2, air from spray enclosure 4 and drying enclosure 6 may be exhausted through an exhaust system 8 comprising filtering mechanism 9, air plenum chamber 11, and exhaust conduit 13, as illustrated in the embodiment of FIG. 2A. Air may be forced through exhaust system 8 by any suitable means, such as a blower 24. In certain embodiments, filtering mechanism 9 may remove certain particulates and undesirable gases, such as paint or primer particulates from overspray, as well as volatile organic compounds (VOCs). In one embodiment, spray booth 2 is self-contained, meaning that the exhaust of spray booth 2 is suitable for introduction, without additional treatment, into the interior ambient air environment of a building, such as, for example, an aircraft manufacturing facility or other manufacturing facility. In one embodiment, the filtered air meets or exceeds government environmental regulations for particulate and/or VOC emissions.

Referring again to FIG. 2, filtering mechanism 9 may comprise any suitable filtering mechanism which will function to remove unwanted gases and/or particulates from the exhaust. The type of filtering mechanism may vary depending on the particular spraying and drying processes performed in spray enclosure 4 and drying enclosure 6, as well as environmental and other governmental regulations for such processes. In certain embodiments, a filtering mechanism may not be required. For example, in some embodiments, the exhaust from spray enclosure 4 and drying enclosure 6 could be routed to the ventilation system of the building in which spray booth 2 is located, rather than employing filtering mechanism 9.

As indicated in the description of FIG. 4 above, filtering may begin with the filters in spray enclosure 4. For example, intake filters 48 reduce filter particulates, such as dust from the air, to reduce contamination of part 54 during the spraying process, and sacrificial filters in back wall 38 and floor 42 aid in capturing overspray. In the illustrated embodiment, the pre-filtered exhaust from spray enclosure 4 is drawn across filtering mechanism 9 before being exhausted from spray booth 2.

As illustrated, filtering mechanism 9 comprises a series of inline filters through which the exhaust is drawn. Filters 70 and 72 are employed to capture solid particulates from the exhaust flow. Any filters which provide suitable particulate filtration may be employed, such as, for example, NESHAP filters and HEPA filters. For example, filter 70 may comprise a NESHAP 319 3-stage filter, and filter 72 may comprise a HEPA filter. In the illustrated embodiment, filter 74 is employed to capture VOCs. Any suitable filter for capturing VOCs may be employed, such as, for example, a carbon filter.

In certain embodiments, sensors may be employed to determine whether filters have become clogged and should be replaced. In one embodiment, sensors are used to detect a pressure drop across filters 70 and 72. Any suitable sensors for detecting air pressure may be employed, such as, for example, pitot tubes. In one embodiment, a first air pressure sensor is positioned in the exhaust system upstream of the filter to be monitored, and a second sensor is positioned in the exhaust stream downstream of the filter to be monitored. Information from the sensors may be displayed using one or more gauges, thereby communicating the pressure differential to the operator. For example, gauges 71 and 73 may be employed to display information regarding a potential pressure drop across filters 70 and 72, respectively. Based on the displayed pressure differential, the operator may determine whether the filter should be replaced.

The number and types of filters in filtering mechanism 9 may vary. For example, in some embodiments, one or more filters for removing particulates may be employed without employing a filter for removing VOCs. In other embodiments, one or more filters for removing VOCs may be employed without employing a filter for removing particulates. Still other filtering means or methods would be readily apparent to one of ordinary skill in the art, and fall within the scope of the present application.

In the illustrated embodiment, once the exhaust flows through filtering mechanism 9, it is diverted vertically upward by plenum 11 and exhausted from spray booth 2 through exhaust conduit 13, as described above. Plenum 11 is enclosed on either side of spray booth 2 by panels 76, and by a bottom member 78, which may be shaped to aid in diverting exhaust flow up through exhaust conduit 13, positioned near the top of plenum 11. A view of plenum chamber 11 without side panels 76 is illustrated in FIG. 3.

In the illustrated embodiment, the filtered exhaust air is diverted vertically upward and exhausted from spray booth 2 through exhaust conduit 13. Exhaust conduit 13 may include a blower 24 for forcing air through the exhaust system. In the spray booth embodiment illustrated in FIG. 3, exhaust conduit 13 is relatively short. In other embodiments, exhaust conduit 13 may be any desired length. For example, a relatively long exhaust conduit 13 may be employed to exhaust the air at a height above the heads of the workers in an indoor facility, to prevent exhaust from interfering with the workers. Additionally, exhausting air from spray booth 2 in a vertical direction, rather than a horizontal direction, advantageously keeps the exhaust from interfering with workers in an adjoining work space.

Further, in embodiments where some harmful airborne particulates and gases remain in the exhaust after filtration, exhausting air in a vertical direction may provide the added benefit of allowing the harmful particulates and gases to be dispersed over a relatively large volume of air before coming into contact with a worker, since the particulates exhausted in an upward direction have more time to mix with air in the surrounding indoor environment, as compared with, for example, an embodiment where the particulates are exhausted directly into a neighboring work space. This may help to reduce the concentration of particulates to which workers near the spray booth 2 are exposed.

In certain embodiments, it may be desirable to maintain a desired flow rate through the exhaust system to, for example, assure adequate flow through spray enclosure 4 and/or drying enclosure 6. In one embodiment, one or more sensors may be employed in the exhaust system to sense a flow rate of air being exhausted from the spray booth. For example, an air flow rate sensor may be positioned near the top of exhaust conduit 13. In yet other embodiments, sensors may be employed in other components of spray booth 2, such as in spray enclosure 4 and/or in drying enclosure 6. Data regarding airflow may be transmitted via a data path from the one or more sensors to control system 12, which can determine, for example, whether the flow rate of air is below a desired minimum flow rate. If the sensed flow rate of air is below the desired minimum flow rate, control system 12 may transmit a signal to blower 24 to increase the blower motor rate and thereby increase the flow rate of air exhausted from spray booth 2 to at least the desired minimum flow rate. In this manner, the flow rate through spray booth 2 may be controlled during operation (e.g., simultaneously with applying the spray material, or drying the spray material, or both).

The design and configuration of plenum 11 and exhaust conduit 13 may be any suitable design or configuration. For example, plenum 11 may have a flat bottom member, which is inclined or horizontal, rather than curved bottom member 78. Further, blower 24 may be positioned somewhere other than in exhaust conduit 13. For example, a blower may be placed in plenum chamber 11, in addition to or in place of blower 24 in exhaust conduit 13. In yet another embodiment, spray booth 2 may employ a horizontal exhaust in place of vertical exhaust conduit 13. For example, one or more exhaust vents could be positioned in the sides or bottom of plenum 11. Still other designs and configurations for plenum 11 and exhaust conduit 13 would be readily apparent to one of ordinary skill in the art, and fall within the scope of the present application.

As illustrated in FIG. 2, the spray booths of the present application may contain a control system 12 for providing, among other things, processes feedback and control for the components of the spray booth. Control system 12 may comprise any suitable processor, such as, for example, a programmable logic controller. A wide variety of techniques for programming the programmable logic controller or other suitable processor of control system 12 are known to those of ordinary skill in the art, and are within the scope of the present application.

In the embodiment illustrated in FIG. 2, the fire suppression system 10 comprises a pneumatic fire suppression system. Pneumatic fire suppression systems are able to function without electricity, offering the advantage of fire protection during blackouts, without the need for a backup battery. In other embodiments, any other suitable fire suppression system may be employed, such as an electrically controlled fire suppression system with or without a battery backup.

In the illustrated embodiment, the fire suppression system comprises a fire suppressant chamber 26 having a control mechanism 28 for controlling a flow of fire suppressant from chamber 26. Fire suppressant chamber 26 may contain, for example, carbon dioxide, or any other suitable fire suppressant. Chamber 26 may be in fluid connection with any desired component of spray booth 2 which is at risk of catching fire and/or explosion. For example, fire suppressant chamber 26 may be in fluid connection with one or more components chosen from spray enclosure 4, drying enclosure 6 and air plenum chamber 11. The fluid connection with fire suppressant chamber 26 may be provided by any suitable means, such as, for example, tubing 30 and nozzles 32, as illustrated in FIGS. 2 and 3. The one or more nozzles 32 may be positioned in any desired location of spray booth 2.

One or more heat sensors 34 may be positioned in spray both 2. For example, as illustrated in FIG. 2A, heat sensors 34 may be positioned in spray enclosure 4 and in plenum chamber 11 (shown in cutaway). In another embodiment, heat sensors 34 may be positioned in other components of spray booth 2, such as drying enclosure 6 or portions of the exhaust system other than plenum chamber 11, such as exhaust conduit 13. The one or more heat sensors 34 are capable of sensing sudden and pronounced changes in heat and triggering control mechanism 28, thereby initiating the flow of fire suppressant from chamber 26 to nozzles 32. In addition, control mechanism 28 can be triggered manually by a user using any suitable manual activation means, such as, for example, a manual pull station 29, illustrated in FIG. 2B.

In certain embodiments, other control mechanisms may be employed to provide safety and/or convenience in operating spray booth 2. In one embodiment, a means for quickly shutting down one or more components of spray booth 2 may be employed. For example, the embodiment of FIG. 2 includes control panels 31, having start and stop buttons for controlling spray enclosure 4 and drying enclosure 6. When a stop button is pushed, the corresponding component or the entire spray booth can be de-energized, including cutting power to the exhaust fans and depressurizing any pneumatics. The appropriate start button may be pushed to individually initiate the spray or drying process.

In another embodiment, a control means may be employed to insure that the equipment is de-energized before spray enclosure 4 is opened to allow operators to access spray gun 47. For example, front wall 36 may include a trip button that must be depressed to allow spray booth 2 to operate. If front wall 36 is open, the button pops out, which signals control system 12 to prevent energizing of spray booth 2. In yet other embodiments, control mechanisms may be employed to de-energize spray booth 2 automatically in the event of, for example, a fire. In other embodiments, mechanisms may also be employed to automatically maintain a desired functionality of spray gun 47. For example, in one such embodiment, spray gun 47 is automatically periodically shaken to maintain proper mixing of the spray material. In another embodiment, short blasts of spray gun 47 are automatically performed at periodic intervals to prevent long time periods of non-operation and reduce the chance of clogging.

Figure 6:
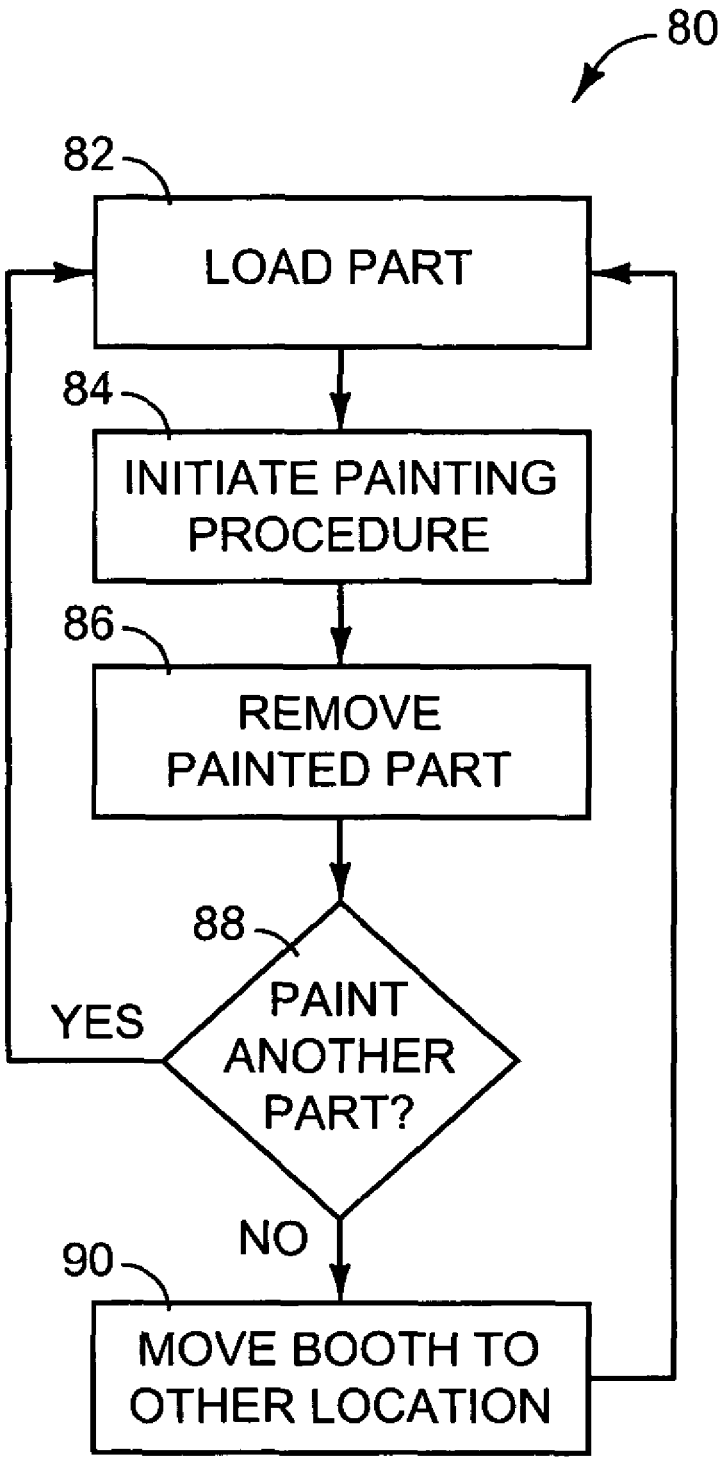
FIG. 6 is a flow chart illustrating a method of operating a portable self-contained spray booth, according to one embodiment of the present application.

FIG. 6 is a flow chart illustrating a method 80 of operating a portable self-contained spray booth, according to one embodiment of the present application. As illustrated, at block 82, an operator loads a part into the spray booth located at a first location, such as for example, a location at or near a production line in a manufacturing facility. At block 84, the operator initiates a painting procedure. In some embodiments, the painting procedure comprises both application and drying of a spray material on the part, as described above. At block 86, the operator removes the painted part.

At block 88, a determination is made as to whether another part is to be painted with the spray booth at the first location. If so, then the process returns to block 82, in which the operator loads the next part into the spray booth at the first location. If not, then at block 90, the spray booth is moved to a second location, such as, for example, a different location on the production line or a location near a different production line in the same manufacturing facility. The movement of the spray booth can be carried out using any suitable mechanism, such as, for example, wheels 20 illustrated in FIGS. 2 and 3. In some embodiments, movement of the spray booth includes securing the spray booth at the second location using any suitable mechanism, such as, for example, stabilizing mechanism 22 illustrated in FIG. 2. Once the spray booth has been moved to the second location, the process returns to block 82, in which the operator loads a part into the spray booth at the second location.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. A self-contained spray booth that enables a component to be painted at or near a production line in a manufacturing facility having interior ambient air, the spray booth comprising:

a first enclosure in which the component is painted;

an exhaust system in pneumatic connection with the first enclosure and including:

a filtering subsystem configured to filter the air from the first enclosure; and a venting subsystem configured to vent the filtered air to the interior ambient air of the manufacturing facility; and a fire suppression system, in fluid connection with the first enclosure, comprising a control mechanism, a fire suppressant chamber, and one or more sensors positioned in the spray booth and capable of triggering the control mechanism thereby initiating a flow of fire suppressant from the fire suppressant chamber.

2. The spray booth of claim 1, further comprising a frame structure including a plurality of wheels.

3. The spray booth of claim 1, wherein the first enclosure comprises one or more air intake filters to reduce filter particulates.

4. The spray booth of claim 1, wherein the first enclosure comprises one or more sacrificial filters to capture overspray.

5. The spray booth of claim 1, wherein the first enclosure comprises a robotic arm and a part holder configured to hold and manipulate the component during painting.

6. The spray booth of claim 1, wherein the first enclosure is enclosed on all sides.

7. The spray booth of claim 1, wherein the first enclosure comprises at least one open side to allow one or more operators to access an interior of the first enclosure while the component is being painted.

8. The spray booth of claim 1, wherein the exhaust system comprises an air plenum chamber configured to divert exhaust air flow vertically upward and exhaust it from the spray booth.

9. The spray booth of claim 1, further comprising:

a first air pressure sensor positioned in the exhaust system upstream of the filtering subsystem;

a second air pressure sensor positioned in the exhaust system downstream of the filtering subsystem;

means for determining a pressure differential between the first and second air pressure sensors; and means for communicating the pressure differential to an operator.

10. The spray booth of claim 9, wherein the means for determining a pressure differential comprises at least one pitot tube.

11. The spray booth of claim 1, wherein the filtering subsystem comprises a NESHAP filter, a HEPA filter, and a carbon filter.

12. The spray booth of claim 1, wherein the exhaust system comprises one or more air flow rate sensors.

13. The spray booth of claim 1, wherein the fire suppression system comprises:

the fire suppressant chamber having the control mechanism for controlling the flow of fire suppressant from the fire suppressant chamber;

the one or more sensors positioned in the spray booth and capable of triggering the control mechanism, thereby initiating the flow of the fire suppressant from the fire suppressant chamber.

14. The spray booth of claim 13, wherein the one or more sensors comprise one or more heat sensors.

15. A self-contained spray booth that enables a component to be painted at or near a production line in a manufacturing facility having interior ambient air, the spray booth comprising:

a first enclosure in which the component is painted;

an exhaust system in pneumatic connection with the first enclosure and including:

(a) a filtering subsystem configured to filter the air from the first enclosure; and (b) a venting subsystem configured to vent the filtered air to the interior ambient air of the manufacturing facility;

a second enclosure in which the painted component is dried, wherein the exhaust system is in fluid connection with the second enclosure so that the air from the second enclosure is filterable and ventable to the interior ambient air of the manufacturing facility;

and at least one of: (1) the second enclosure comprises a part chamber and a heating chamber including a heating element; (2) the second enclosure comprises one or more sensors configured to detect the presence of a component and to signal a processor to prevent activation of a heating element within the second enclosure until a component is present; or (3) a processor is configured to control processing operations in the first enclosure and the second enclosure and to regulate the flow of exhaust air through the exhaust system.

16. The spray booth of claim 15, wherein the second enclosure comprises the part chamber and the heating chamber including the heating element.

17. The spray booth of claim 16, wherein the heating element comprises an infrared bulb.

18. The spray booth of claim 15, wherein the second enclosure comprises the one or more sensors configured to detect the presence of the component and to signal the processor to prevent activation of the heating element within the second enclosure until the component is present.

19. The spray booth of claim 15, wherein the second enclosure is positioned below the first enclosure and is angled at about 45°.

20. The spray booth of claim 15, wherein the second enclosure is positioned at approximately a same height level as the first enclosure.

21. The spray booth of claim 15, further comprising the processor configured to control processing operations in the first enclosure and the second enclosure and to regulate the flow of exhaust air through the exhaust system.

22. The spray booth of claim 21, wherein the processor comprises a programmable logic controller.

* * * * *